US005246191A

United States Patent [19]

Moss

[11] Patent Number: 5,246,191

[45] Date of Patent: Sep. 21, 1993

[54] CRADLE ASSEMBLY FOR A MOVEABLE ARM SUPPORT SYSTEM

[76] Inventor: James Moss, 650 S. Hedgecock Sq., Satellite Beach, Fla. 32937

[21] Appl. No.: 778,365

[22] Filed: Oct. 17, 1991

[51] Int. Cl.[5] ..... A47B 21/00

[52] U.S. Cl. ..... 248/118.3

[58] Field of Search ..... 248/118, 118.1, 118.3, 248/118.5, 571, 123.1, 297.1, 292.1, 280.1

[56] References Cited

U.S. PATENT DOCUMENTS

| | | | |
|---|---|---|---|
| 1,945,419 | 1/1934 | Brown | 248/118 |
| 2,403,654 | 7/1946 | Gerdes | 248/118 |
| 3,179,364 | 4/1965 | Jackson et al. | 248/571 |
| 3,973,748 | 8/1976 | Nagasaka | 248/571 |
| 4,163,536 | 8/1979 | Heller et al. | 248/118 |
| 4,822,103 | 4/1989 | Stenvall | 248/118 X |
| 5,058,840 | 10/1991 | Moss et al. | 248/118.5 |

FOREIGN PATENT DOCUMENTS

| | | | |
|---|---|---|---|
| 8900111 | 1/1989 | World Int. Prop. O. | 248/118 |

OTHER PUBLICATIONS

Design News, Nov. 4, 1985, reprint, Counterbalance Torque is Adjustable, Compact, 4 pages.

*Primary Examiner*—Alvin C. Chin-Shue

*Attorney, Agent, or Firm*—Evenson, Wands, Edwards, Lenahan & McKeown

[57] ABSTRACT

A floating cradle assembly for an arm support system is provided with a yoke having cam surfaces and crank-controlled followers arranged to ride along the cam surfaces as the cradle moves vertically with respect to the yoke. As a result, the user of the arm support system experiences as uniform upward biasing force, and the yoke will not bind within the cradle housing. Different cam surface configurations will also result in different magnitudes of the uniform upward biasing force to accommodate the user's comfort.

20 Claims, 8 Drawing Sheets

CRADLE ASSEMBLY FOR A MOVEABLE ARM SUPPORT SYSTEM

BACKGROUND AND SUMMARY OF THE INVENTION

The present invention relates generally to an ergonometric moveable support arm used for computer peripheral equipment, e.g. a mouse or keyboard, and, more particularly, to a support arm with a controlled vertical bias which provides greater stability and adjustable spring loads.

A floating moveable arm supports is now available for providing an upward bias to the user's arm in order to overcome some of the effects of gravity while performing tasks of long duration. One such support is shown in FIGS. 1–3 whose constructional details are described below. To provide a cradle that moves with the user's arm and continually provide an upward bias thereagainst, an upward spring load can be arranged at each side of the cradle as seen in FIGS. 4 and 5 also discussed in greater detail below. With such an arrangement, however, the system becomes unstable if the arm weight is not uniformly distributed to each spring and all the load shifts to only one of the springs. In practice, such uniform distribution is often not achieved. Non-uniform arm weight distribution also causes the yoke to bind in the cradle with consequent unacceptable results. Another disadvantage of this approach is that the upward biasing force changes with the vertical displacement based on the spring rate. Moreover, each cradle assembly is manufactured with a particular spring load that cannot easily be changed by the user. Thus, if the cradle force is too high or too low, a new cradle assembly must be installed at much additional cost.

Counterbalancing mechanisms are known which utilize a torsion bar and cam arrangement for providing positive control for heavy container lids. One such torque-bar counterbalance mechanism is shown in *Design News,* Nov. 4, 1985. This mechanism is designed, however, for more complex applications on which elaborate covers are employed and in which it is necessary to determine the center of gravity and its path, and a dynamic nomograph or computer is used to correlate the wide variety of cover possibilities with the possible counterbalancing mechanisms. In addition, a positively locking vernier gear is provided to fine-tune the balancing by manipulation of multiple gear meshes. Although such a mechanism may be suitable for heavy lids and covers, it is too complex and expensive for arm supports of the type to which the present invention is directed.

It is an object of the present invention to provide an arm support which is both simple in construction and inexpensive to produce while producing a constant or uniform upward biasing reaction force.

It is a further object of the present invention to permit the substitution of different cradles in an economic manner to obtain different magnitudes of uniform upward force in accordance with the user's comfort.

It is still a further object of the present invention to achieve stability of the cradle and thereby allow tilting of the cradle to comply with natural arm movements without binding the yoke within the cradle.

I have found that the disadvantages associated with known devices for arm support can be overcome and the above-stated objects achieved by configuring the yoke with cam surfaces. In particular, in one embodiment of the present invention, four grooved followers in the form, for example, of two sets of opposed wheels made of Nylon, Teflon or the like are arranged within the cradle housing and ride along cam surfaces on each side of a U-shaped yoke as the cradle housing moves relative to the yoke. A set of two followers is provided to engage cam surfaces and is arranged at each side or leg of the yoke. The followers are normally biased toward one another onto the cam surfaces by a coiled tension spring. Movement of the followers on both sides of the yoke is controlled by two rotatable crank rods which extend between the yoke legs, thereby providing system stability to avoid binding of the yoke within the cradle as the user's arm undergoes tilting movements.

Another feature of the present invention resides in that the configuration and size of the cam surfaces on the legs of the yokes can be varied to obtain constant or uniform upward reaction forces of different magnitudes in accordance with the user's comfort.

In another embodiment of the present invention, the cam surfaces on the yoke can be provided with a notch to restrict, where desired along the path of relative movement between the cradle housing and yoke, vertical movement of the cradle while still permitting the cradle housing to pivot and tilt.

BRIEF DESCRIPTION OF THE DRAWINGS

These and other objects, features and advantages of the present invention will become more readily apparent from the following detailed description of currently preferred embodiments when taken in conjunction with the accompanying drawings wherein.

DETAILED DESCRIPTION OF THE DRAWINGS

Figure 1:
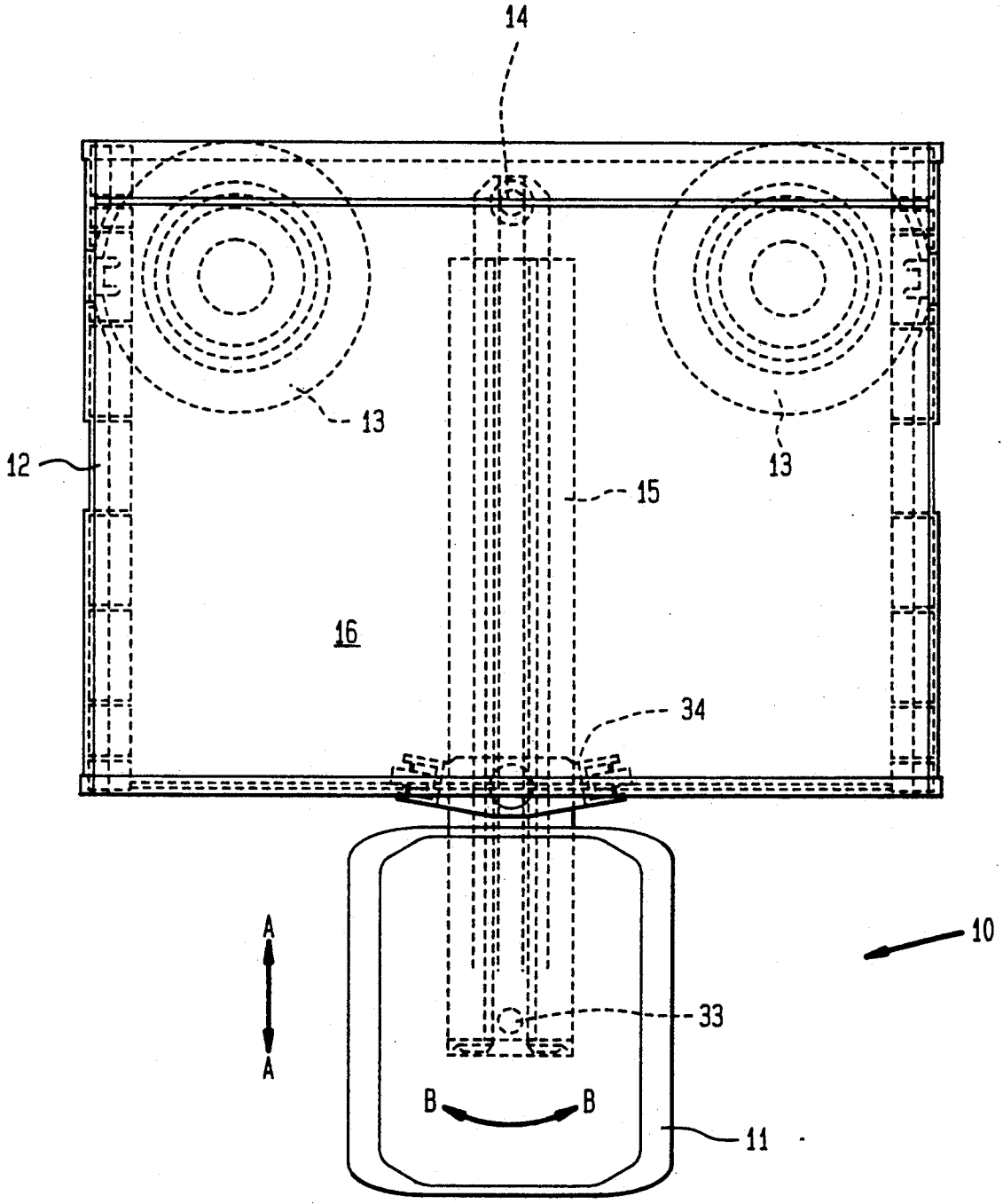
FIG. 1 is a plan view of a currently available arm support system for users of computer peripherals such as a mouse or a keyboard.
Figure 2:
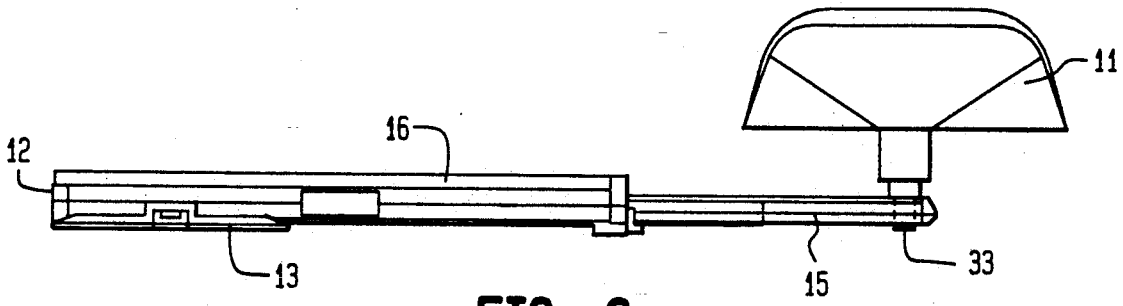
FIG. 2 is a side elevational view of the arm support system of FIG. 1.
Figure 3:
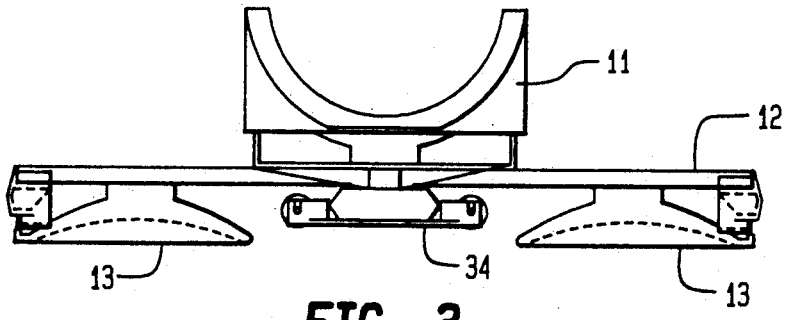
FIG. 3 is a front elevational view of the arm support system of FIGS. 1 and 2.

FIGS. 1–3 show an available moveable arm support designated generally by the numeral 10 and of the type described in U.S. Pat. No. 5,058,840, the disclosure of which is incorporated by reference herein. Generally speaking, the support 10 has a floating cradle 11 to provide an upward bias to a user's arm and to pivot around a support post 33 in response to movement of the user's arm. This arrangement overcomes the effects of gravity on the user's arm while performing tasks of long duration. Generally, the arm support device 10 comprises an extruded platen 12 sized in this instance to hold a computer mouse (not shown) or as shown in said U.S. Patent to fit under a P.C. keyboard, vacuum cups 13 at the rear corners of the underside of the platen 12 to hold the latter fast on a support surface, and a pivot 14 for allowing pivoting movement of a slide assembly 15 carrying the cradle 11. A pad 16 can be arranged on top of the platen 12 for cushioningly supporting the mouse. The slide assembly 15 is a multi-part telescoping arrangement which allows the cradle assembly 11 to be moved inwardly and outwardly relative to the platen 12 in the directions of double-headed arrow A in FIG. 1 and also swivelled around fixed pivot 14 in the directions of double-headed arrow B along a wheeled bracket 34.

Figure 5:
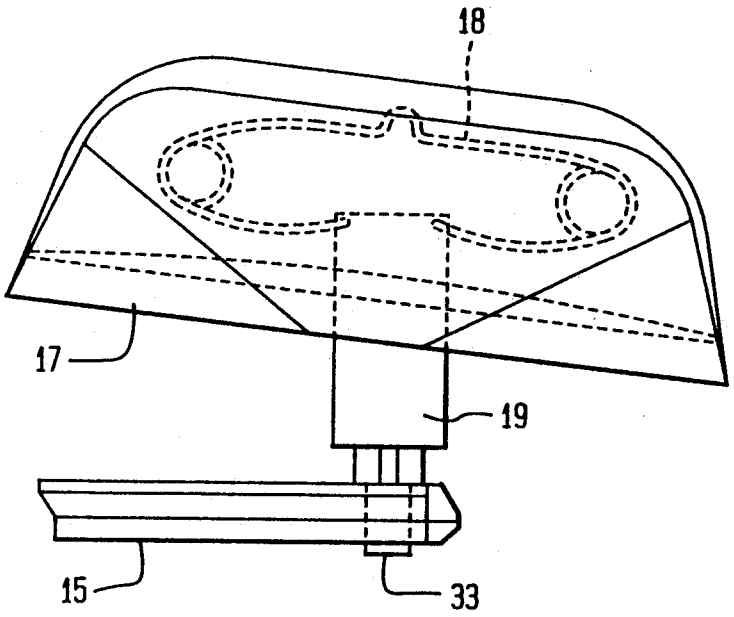
FIG. 5 is a side elevational view of the cradle assembly shown in FIG. 4 but with the cradle housing in an inclined position due, for example, to the tilting caused by a user's arm (not shown)
Figure 4:
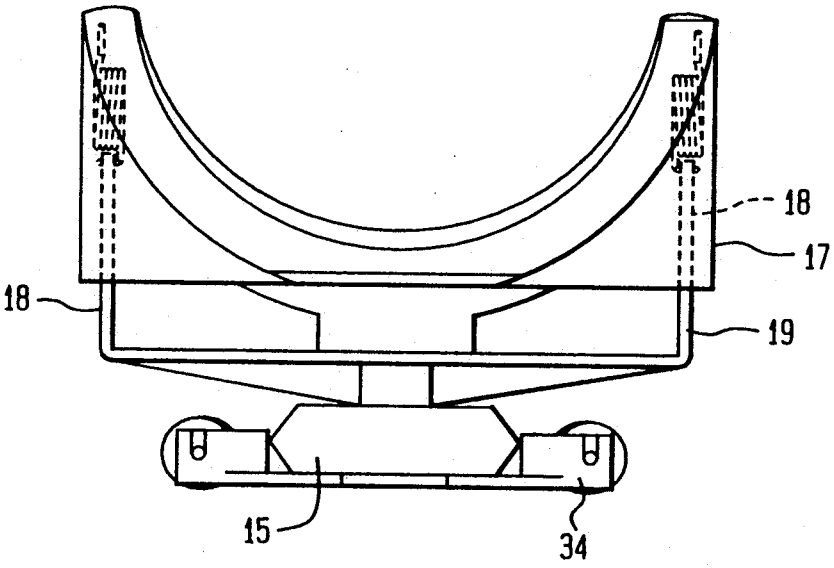
FIG. 4 is a front elevational view of a cradle assembly used, for example, with the arm support of FIGS. 1–3 in which the cradle housing is supported with independent torsion springs.
Figure 8:
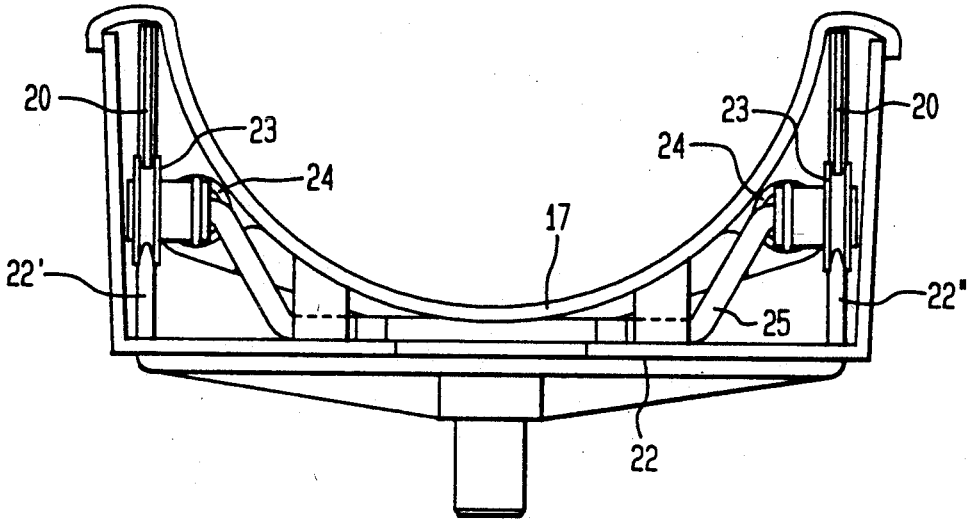
FIG. 8 is a front elevational view of the arm support cradle of FIG. 6 utilizing the cam controlled cradle bias with force stabilizers but shown in a position where the weight of the user's arm (not shown) forces the cradle downwardly relative to the yoke.
Figure 6:
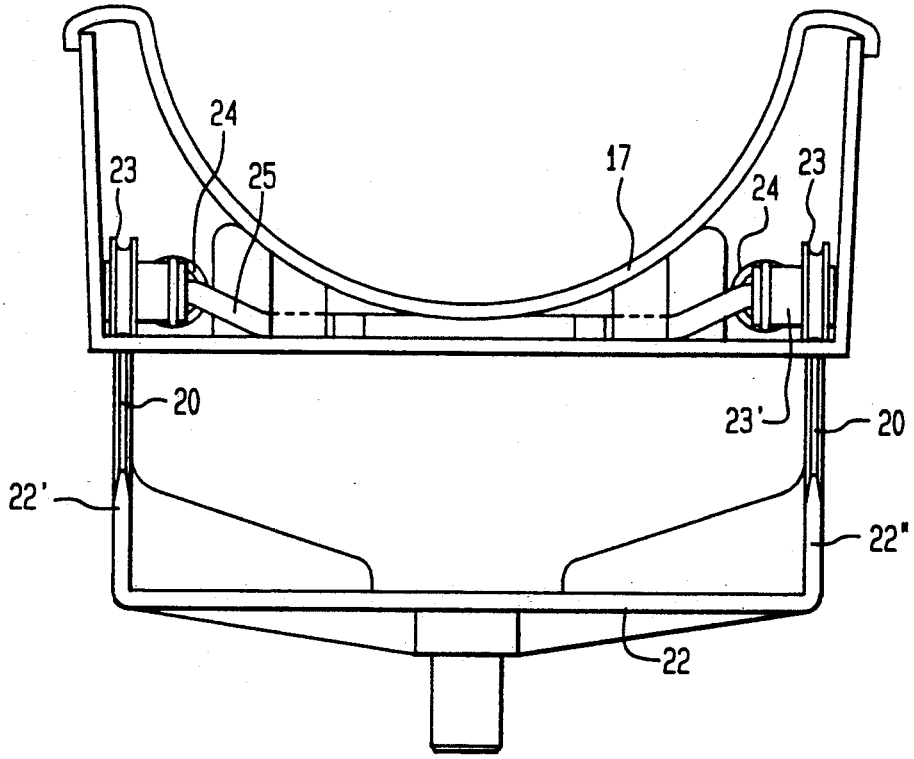
FIG. 6 is a front elevational view of a cradle assembly in accordance with one embodiment of the present invention in which two sets of following wheels are mounted on cranks to provide a force-stabilized, cam-controlled bias and the cradle is shown in the normal, unweighted position relative to the yoke.

To achieve the floating support in the cradle 11, one current approach is to support the cradle 11 on each side by independent torsion springs 18 (FIGS. 4 and 5) with the aim of providing a continuous upward spring load. The cradle housing 17 moves with the user's arm, but I have found that if the arm weight is not distributed uniformly to each spring 18, the system may become unstable because the load shifts to one spring and causes the yoke 19 mounted on the pivot support 33 to bind in the cradle housing 17. Moreover, in this arrangement the upward biasing force changes with the vertical displacement of the cradle housing 17 based on the spring rate of the torsion springs 18. Each cradle assembly is provided with a specifically sized set of springs 18 that cannot easily be changed by the user. If the cradle force is either too high or too low, a new cradle assembly must be installed to suit the user's comfort level.

Figure 9:
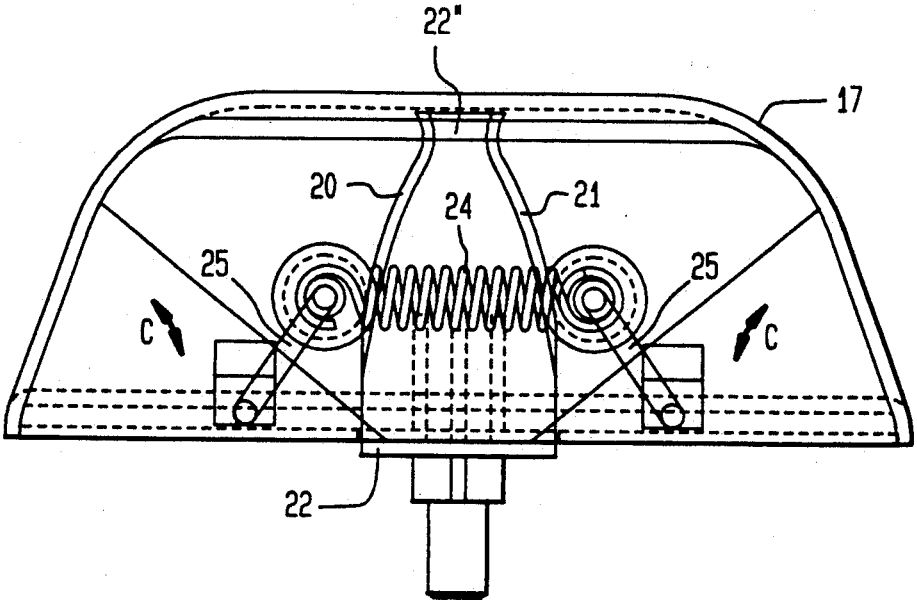
FIG. 9 is a side elevational view of the depressed cradle shown in FIG. 8.
Figure 7:
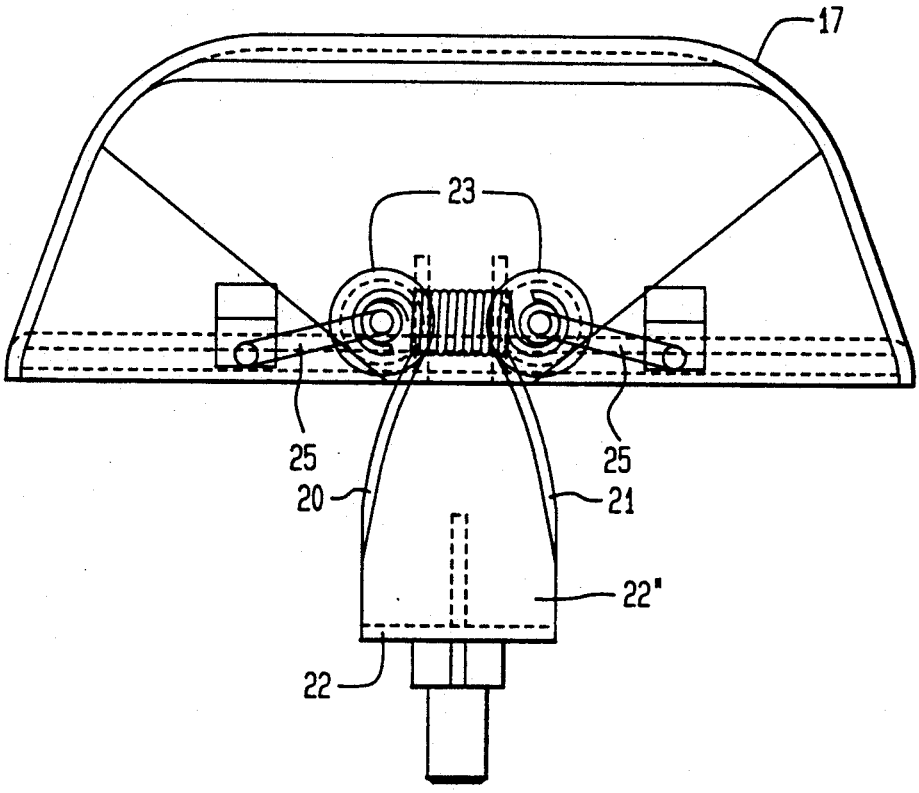
FIG. 7 is a side elevational view of the unweighted cradle shown in FIG. 6.
Figure 10:
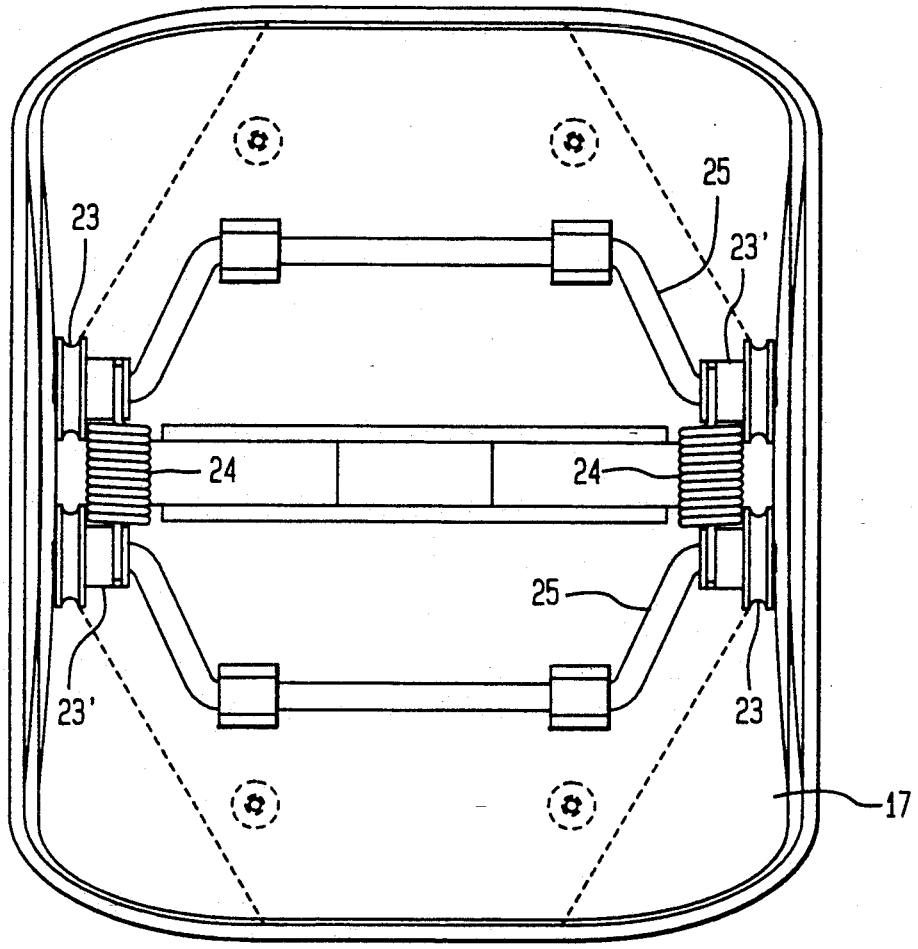
FIG. 10 is a top plan view of the cradle shown in FIGS. 6–9 but without the yoke.

In one embodiment of the present invention shown in FIGS. 6–10, particularly FIGS. 7 and 9, cam surfaces 20 and 21 are configured on each 22', 22" side or leg of a U-shaped yoke 22 and approach one another in a tapering manner as they extend toward the free end of the legs of yoke 22. Two sets of two opposed grooved follower wheels 23 are arranged on each side of the yoke 22 so that the groove surface of the wheels 23 provides a positive engagement with a respective one of the cam surfaces 20, 21 on the respective legs 22' of the U-shaped yoke 22. The opposed follower wheels 23 in each set are positively biased toward the cam surfaces 20, 21 by a tension spring 24 mounted on a hub 23' of the wheels 23 so that the latter are constrained to ride along the cam surfaces 20, 21 as the cradle housing 17 moves vertically up and down relative to the yoke 22. Cranks 25 rotatably mounted in the cradle housing 17 are provided to rotatably connect opposed follower wheels of each set of followers transversely of the cradle housing 17 and thereby control movement of the follower wheels 23 on opposite sides of the yoke 22 to stabilize the system even if the arm load is shifted to one side of the yoke 22 caused by tilting of the user's arm.

As can be seen more clearly in FIGS. 7 and 9, the follower wheels 23 of each set move toward and away from one another by way of the bias of the spring 24 when the cradle housing 17 is relieved of the user's weight or is pushed down onto the yoke 22 by the weight of the user's arm. In turn, a uniform upward reaction against the downward force is created. Because the cranks 25 are also caused to rotate in the direction C of double headed arrows as the follower wheels 23 are spread apart as they ride down the cam surfaces 20, 21, the cranks 25 extend both springs 24 almost equally even when the applied arm load is not centered in the cradle housing 17 and thus serve as stabilizer rods. Thus, this embodiment allows the cradle to tilt to comply with natural arm movements without sacrificing stability or binding of the yoke 22 within the cradle 17. Moreover, since the weight of the user's arm is essentially constant, the cam profile provides a substantially uniform upward bias. Should system requirements dictate, however, the cam profile can easily be reconfigured to provide other upward biasing forces, e.g. sinusoidal, without departing from the scope of the present invention.

Figure 11:
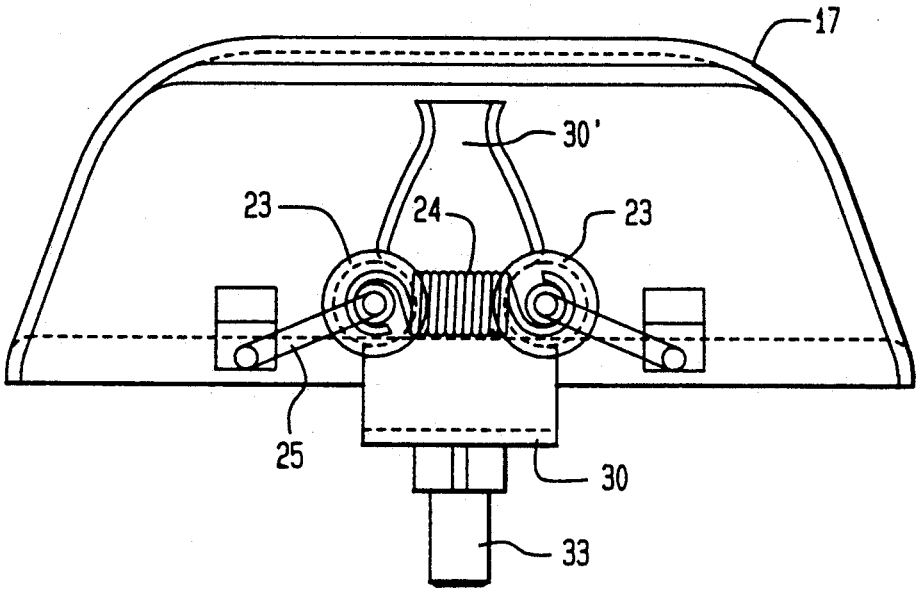
FIG. 11 is a side elevational view similar to FIG. 6 but showing another embodiment of the cradle assembly in accordance with the present invention in which the yoke is notched to restrict vertical motion without preventing tilting and pivoting of the cradle.
Figure 12:
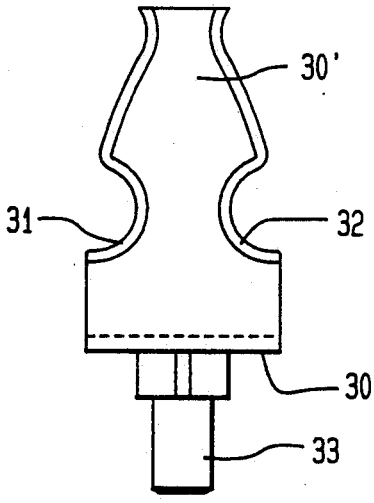
FIG. 12 is an isolated, side elevational view of the notched yoke used with the cradle assembly of FIG. 11.
Figure 13A:
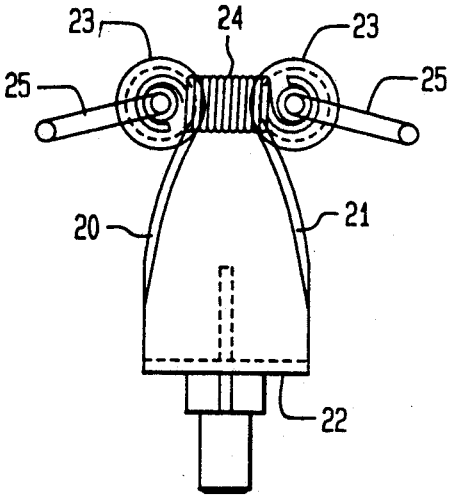
FIGS. 13A through 13F are side elevational views of three different cam surface configurations for the cradle of FIGS. 6–9 showing how the magnitude of vertical force can be modified by using different cam surface configurations.
Figure 13B:
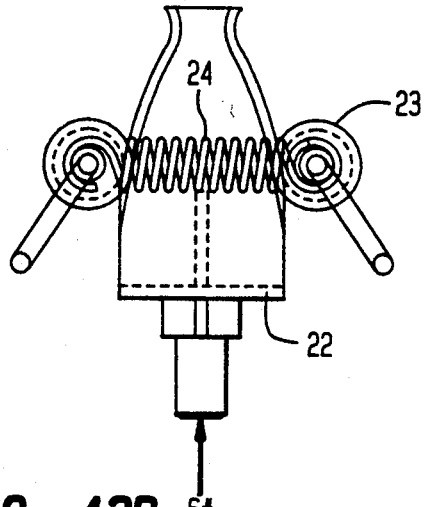
Figure 13C:
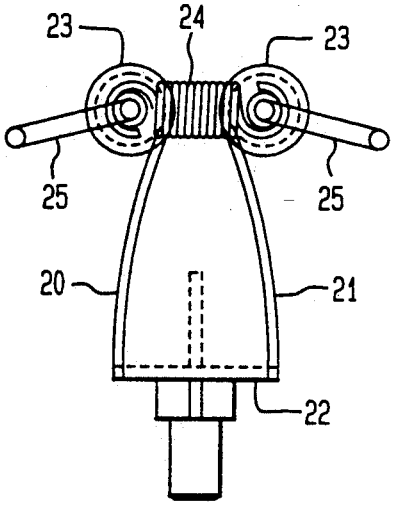
Figure 13D:
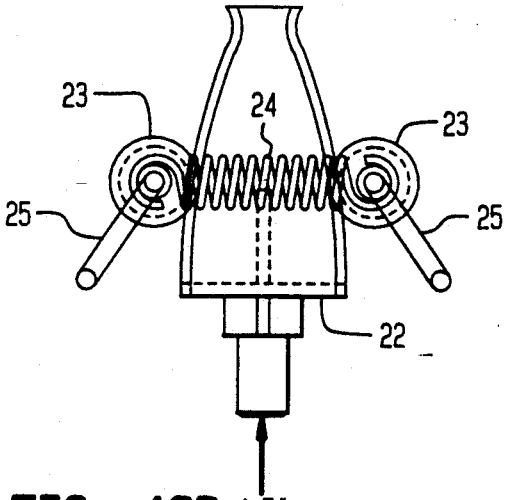
Figure 13E:
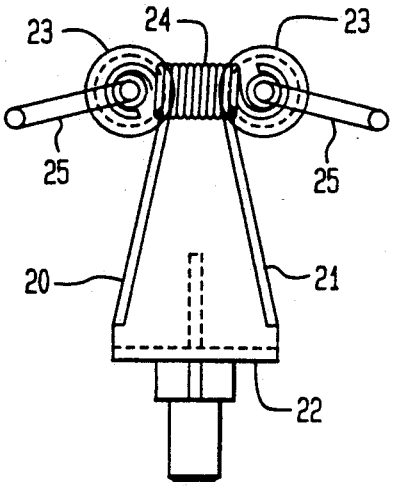
Figure 13F:
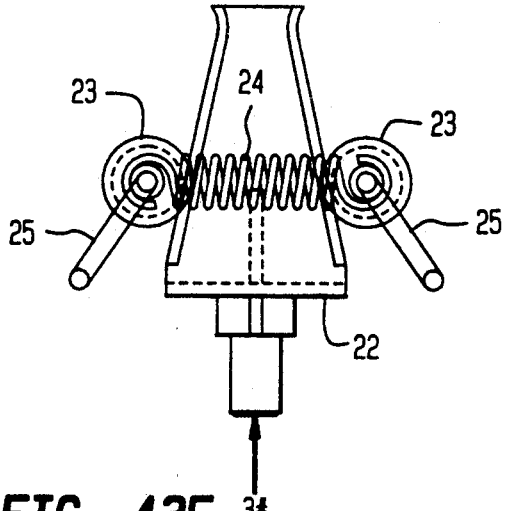

As shown in the alternative embodiment illustrated in FIGS. 11 and 12, two notches 31, 32 can be provided in the legs or sides 30' of the modified yoke 30 for those applications where no upward vertical base is needed or desired. In all other respects, however, this embodiment is identical in construction to the cradle housing 17 shown in FIGS. 6–9 and, therefore, identical parts are designated by the same numerals in FIGS. 11 and 12. As a result of the notches 31, 32 in which the previously described follower wheels 23 are sized to engage and in which they are retained under the bias of spring 24, the cam reaction on the follower wheels 23 is disenabled when the notches 31, 32 are encountered, thereby eliminating the vertical upward bias but still permitting the cradle housing 17 to pivot and tilt in accordance with the user's arm movements.

According to yet another advantageous feature of the present invention as shown in FIGS. 13A–13F, the vertical upward biasing forces can be selectively modified by utilizing cams with different cam profiles. For example, with a pronounced curved cam profile of the type shown in FIGS. 13A and 13B (essentially the same as that shown in the embodiments of FIGS. 6–9 and 11 and 12), a 6 lb. upward force can be provided as the follower wheels 23 move downward along the cam surfaces 20, 21 as the cradle 17 (not shown) is depressed by the user's arm from the position shown in FIG. 13A to the position in FIG. 13B. Similarly, with the somewhat less sharply curved cam profile shown in FIGS. 13C and 13D, a 4.5 lb. upward force results as the cradle moves downwardly; and with a straight profile of the type shown in FIGS. 13E and 13F, a 3 lb. force results. Of course, it will be readily appreciated that these values are merely exemplary and further that a full range of biasing forces can be provided depending upon the size and configuration of the profiles of the cam surface 20, 21, the spring 24, the follower wheels 23 and the cranks 25. Three or four different yokes can be provided with each cradle assembly to provide a different vertical bias at a small additional cost. This provides the user with greater flexibility to obtain the most comfortable cradle assembly. This approach is practical because the yoke is a relatively low-cost injection modeled part that can be supplied in different configurations with each cradle assembly.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. In an arm support system, the improvement comprising a cradle assembly having a cradle housing configured to receive a person's arm, a yoke movable within the cradle housing, and means within the cradle housing operatively connecting the cradle housing and lateral portions of the yoke for exerting a stabilized, substantially constant upward biasing force for the person's arm as the cradle housing moves substantially vertically relative to the yoke.

2. The arm support systems according to claim 1, wherein the yoke is rotatably mounted within a component of the arm support system.

3. The arm support system according to claim 1, wherein the cradle housing is tiltable with respect to the yoke.

4. The arm support system according to claim 1, wherein the means includes structure for preventing relative movement between the cradle housing and the yoke at a desired point within a path of movement of the cradle housing substantially vertically relative to the yoke.

5. The arm support system according to claim 2, wherein the cradle housing is tiltable with respect to the yoke.

6. The arm support system according to claim 3, wherein the means includes structure for preventing relative movement between the cradle housing and the yoke at a desired point within a path of movement of the cradle housing substantially vertically relative to the yoke.

7. A cradle assembly adapted for use with an arm support system, comprising a housing, a yoke, and a mechanism operatively connecting the housing and the yoke to permit substantially vertical relative movement of the housing relative to the yoke when a person's arm is received on the housing and to exert a substantially uniform upward biasing force against the housing.

8. The cradle assembly according to claim 7, wherein the housing is configured to the person's arm.

9. The cradle assembly according to claim 7, wherein the mechanism comprises cam surfaces arranged on the yoke, followers mounted in the housing to engage the cam surfaces, and a device for positively biasing the followers against the cam surfaces.

10. The cradle assembly according to claim 9, wherein the followers are operatively mounted on crank mechanisms and at opposed sides of the housing to prevent binding of the yoke within the housing caused by unequal weighting of the housing by the person's arm.

11. The cradle assembly according to claim 10, wherein the yoke is substantially U-shaped with upstanding legs arranged through a bottom and the opposed sides of housing, the cam surfaces are arranged along edges of the legs and are configured to provide a specified magnitude of the uniform upward biasing force.

12. The cradle assembly according to claim 10, wherein the followers are wheels rotatably mounted on the crank mechanisms, the crank mechanisms are rotatably mounted relative to the housing, and the device is a tension spring connecting followers at each of the opposed sides of the housing.

13. The cradle assembly according to claim 12, wherein the yoke is substantially U-shaped with upstanding legs arranged through a bottom and the opposed sides of housing, the cam surfaces are arranged along edges of the legs and are configured to provide a specified magnitude of the uniform upward biasing force.

14. The cradle assembly according to claim 11, wherein portions of the edges of the legs are adapted to receive the followers selectively to prevent the substantially vertical relative movement between the housing and the yoke.

15. The cradle assembly according to claim 14, wherein the followers are wheels rotatably mounted on the crank mechanisms, the crank mechanisms are rotatably mounted relative to the housing, and the device is a tension spring connecting followers at each of the opposed sides of the housing.

16. The cradle assembly according to claim 7, wherein the yoke is pivotable with respect to the arm support system.

17. The cradle assembly according to claim 7, wherein the housing is tiltable with respect to the yoke.

18. The cradle assembly according to claim 17, wherein the housing is configured to the person's arm.

19. A cradle assembly mounting method, comprising the steps of arranging a cradle housing for substantially vertical and tilting movements relative to a yoke, and exerting a stabilized, substantially uniform upward biasing force on the cradle housing in reaction to a downward force on the cradle housing which causes the substantial vertical movement of the cradle housing relative to the yoke.

20. The cradle assembly mounting method according to claim 19, further comprising the step of selectively precluding the substantially vertical movement of the housing relative to the yoke at a selected point along a path of movement of the cradle housing while permitting the tilting movement of the cradle housing relative to the yoke.

* * * * *